US012766369B2

(12) United States Patent
Motokawa

(10) Patent No.: US 12,766,369 B2
(45) Date of Patent: Oct. 20, 2026

(54) GOLF CLUB HEAD

(71) Applicant: SUMITOMO RUBBER INDUSTRIES, LTD., Kobe (JP)

(72) Inventor: Yuki Motokawa, Kobe (JP)

(73) Assignee: SUMITOMO RUBBER INDUSTRIES, LTD, Kobe (JP)

( * ) Notice: Subject to any disclaimer, the term of this patent is extended or adjusted under 35 U.S.C. 154(b) by 314 days.

(21) Appl. No.: 18/528,939

(22) Filed: Dec. 5, 2023

(65) Prior Publication Data

US 2024/0181304 A1 Jun. 6, 2024

(30) Foreign Application Priority Data

Dec. 6, 2022 (JP) ..... 2022-194878

(51) Int. Cl.
*A63B 53/04* (2015.01)
*A63B 102/32* (2015.01)

(52) U.S. Cl.
CPC ..... *A63B 53/0408* (2020.08); *A63B 53/0458* (2020.08); *A63B 2102/32* (2015.10)

(58) Field of Classification Search
CPC ..... A63B 53/0462; A63B 53/0466; A63B 53/0458; A63B 53/0408
See application file for complete search history.

(56) References Cited

U.S. PATENT DOCUMENTS 4,489,945 A * 12/1984 Kobayashi ..... A63B 53/0466 473/346
5,429,365 A * 7/1995 McKeighen ..... B22C 9/10 164/45
2002/0055391 A1 5/2002 Teramoto
2008/0020858 A1 1/2008 Kusumoto
2014/0179458 A1 6/2014 Jertson
2018/0126228 A1* 5/2018 Penney ..... A63B 60/52
2018/0161645 A1 6/2018 Yoshida et al.

FOREIGN PATENT DOCUMENTS

JP 11-333037 A 12/1999
JP 2007-185502 A 7/2007
JP 2018-93958 A 6/2018

* cited by examiner

*Primary Examiner* — Raeann Gorden
(74) *Attorney, Agent, or Firm* — Birch, Stewart, Kolasch & Birch, LLP

(57) ABSTRACT

A head includes a face portion including a striking face. The striking face includes a sweet spot and a face center. The face portion is divided into an upper part and a lower part by a horizontal plane passing through the sweet spot. The lower part includes a thick wall portion having a wall thickness greater than a maximum wall thickness of the upper part. At least a part of the thick wall portion is a thickest wall portion. A width of 30% of an up-down directional width of the lower part at the position of the face center is defined as an offset width. A region that has a width of the offset width and has a lower contour coinciding with a contour line of the striking face is defined as the lower peripheral region. The entire thick wall portion is disposed in the lower peripheral region.

20 Claims, 9 Drawing Sheets

Cross section taken along line E1

GOLF CLUB HEAD

CROSS REFERENCE TO RELATED APPLICATION

The present application claims priority to Japanese Patent Application No. 2022-194878 filed on Dec. 6, 2022. The entire contents of this Japanese Patent Application are hereby incorporated by reference.

BACKGROUND

Technical Field

The present disclosure relates to golf club heads.

Description of the Related Art

There has been proposed a golf club head that includes a face portion having a varying wall thickness. US 2014/0179458A discloses iron type golf club heads including a long iron whose face portion has a wall thickness increasing downwardly and a short iron whose face portion has a wall thickness increasing upwardly.

SUMMARY

Variation of wall thickness in a face portion can adjust the position of the center of gravity of the head. A part having a large wall thickness, however, is hard to bend and can bring about deterioration of rebound performance. The inventor of the present disclosure has found that a new structure of a face portion can enhance club head performance.

One of the objects of the present disclosure is to provide a golf club head that has an improved performance with a new structure of its face portion.

In one aspect, a golf club head includes a face portion that includes a striking face, a sole portion, a crown portion, a hosel portion, and a head center of gravity. The striking face includes a face center and a sweet spot that is an intersection point between the striking face and a straight line that passes through the head center of gravity and is perpendicular to the striking face. When the face portion is divided into an upper part and a lower part by a horizontal plane that passes through the sweet spot, the lower part includes a thick wall portion that has a wall thickness greater than a maximum wall thickness of the upper part. At least a part of the thick wall portion is a thickest wall portion that has a maximum wall thickness in the face portion. A width of 30% of an up-down directional width of the lower part at the position of the face center is referred to as an offset width. Of the lower part, a region that has a width of the offset width and has a lower contour coinciding with a contour line of the striking face is defined as a lower peripheral region. The entirety of the thick wall portion is disposed in the lower peripheral region.

DESCRIPTION OF THE PREFERRED EMBODIMENTS

Hereinafter, embodiments will be described in detail with appropriate references to the accompanying drawings.

In the present disclosure, a reference state, a reference perpendicular plane, a toe-heel direction, a face-back direction, an up-down direction, a front elevation view, and a face center are defined as follows.

Figure 9:
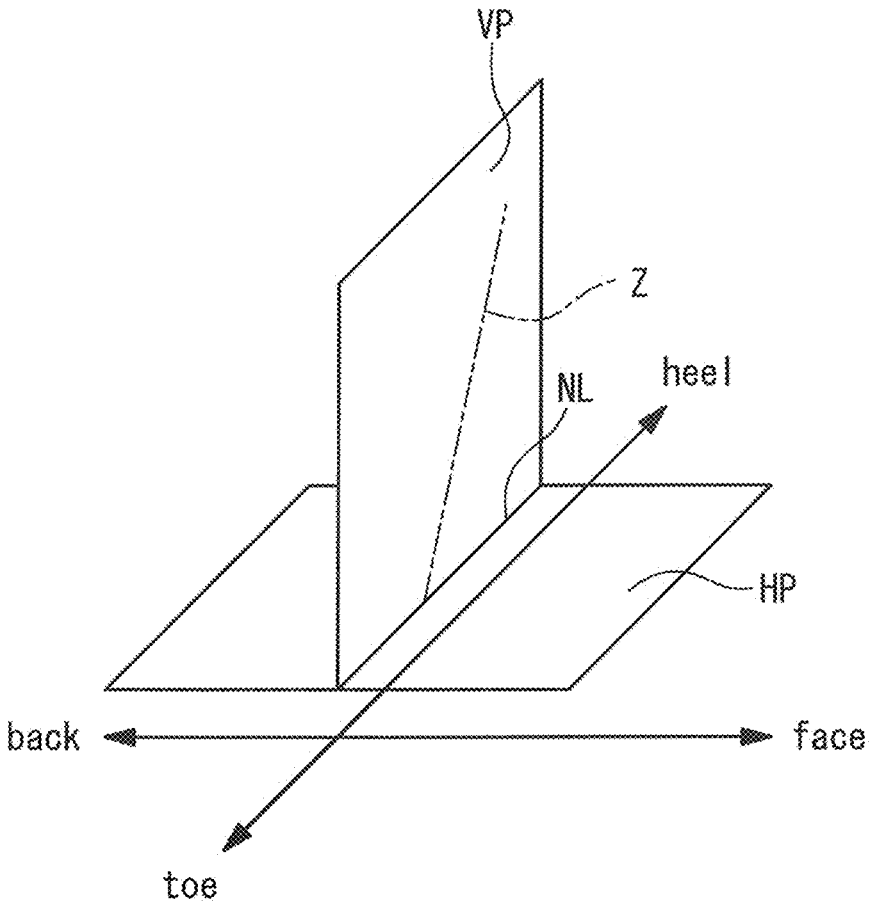
FIG. 9 is a conceptual diagram for illustrating a reference state.

The reference state is a state where a head is placed at a predetermined lie angle on a ground plane HP. As shown in FIG. 9, in the reference state, a shaft axis line Z lies on (is contained in) a plane VP that is perpendicular to the ground plane HP. The shaft axis line Z is the center line of a shaft. The shaft axis line Z normally coincides with the center line of a hosel hole. The plane VP is referred to as the reference perpendicular plane. The predetermined lie angle is shown in a product catalog, for example.

There has been known a club in which its loft angle, lie angle and face angle can be adjusted by, for example, changing a rotational position of a sleeve provided at a tip portion of a shaft. In such a club, the sleeve can be detachably fixed to the head with a fixing means such as a screw. For this reason, in this club, the shaft is attachable to/detachable from the head. In a club having such an attachable/detachable mechanism, the shaft axis line Z is determined in a state where all adjustable items are set to be neutral, i.e., the club is in the reference state. The term "neutral" means the center of the range of adjustment. Clubs of the present disclosure may include such an attachable/detachable mechanism.

In the reference state, a face angle is 0°. That is, in a planar view of a head as viewed from above, a line normal to its striking face at the face center is set to be perpendicular to the toe-heel direction. The definitions of the face center and the toe-heel direction are as explained below.

In the present disclosure, the toe-heel direction is the direction of an intersection line NL between the reference perpendicular plane VP and the ground plane HP (see FIG. 9). A toe side in the toe-heel direction is also simply referred to as "toe side". A heel side in the toe-heel direction is also simply referred to as "heel side".

In the present disclosure, the face-back direction is a direction that is perpendicular to the toe-heel direction and is parallel to the ground plane HP. A face side in the face-back direction is also simply referred to as "face side". The face side is also referred to as "front side". A back side in the face-back direction is also simply referred to as "back side". The back side is also referred to as "rear side".

The front elevation view in the present disclosure means a front view of a head which is in the reference state as viewed from the face side. That is, the front elevation view means a projected figure obtained by projecting a head which is in the reference state onto a plane parallel to the reference perpendicular plane VP. The projected figure is obtained by vertical projection.

In the present disclosure, the up-down direction is a direction that is perpendicular to the toe-heel direction and is perpendicular to the face-back direction. In other words, the up-down direction in the present disclosure is a direction perpendicular to the ground plane HP. An upper side in the up-down direction is also simply referred to as "upper side". A lower side in the up-down direction is also simply referred to as "lower side".

In the present disclosure, the face center Fc is determined in the following manner. First, a point Pr is selected roughly at the center of a striking face in the up-down direction and the toe-heel direction. Next, a plane that passes through the point Pr, extends in the direction of a line normal to the striking face at the point Pr, and is parallel to the toe-heel direction is determined. An intersection line between this plane and the striking face is drawn, and a midpoint Px of this intersection line is determined. Next, a plane that passes through the midpoint Px, extends in the direction of a line normal to the striking face at the midpoint Px, and is parallel to the up-down direction is determined. An intersection line between this plane and the striking face is drawn, and a midpoint Py of this intersection line is determined. Next, a plane that passes through the midpoint Py, extends in the direction of a line normal to the striking face at the midpoint Py, and is parallel to the toe-heel direction is determined. An intersection line between this plane and the striking face is drawn, and a midpoint Px of this intersection line is newly determined. Next, a plane that passes through this newly-determined midpoint Px, extends in the direction of a line normal to the striking face at this midpoint Px, and is parallel to the up-down direction is determined. An intersection line between this plane and the striking face is drawn, and a midpoint Py of this intersection line is newly determined. By repeating the above-described steps, points Px and Py are sequentially determined. In the course of repeating these steps, when the distance between a newly-determined midpoint Py and a midpoint Py determined in the immediately preceding step first becomes less than or equal to 0.5 mm, the newly-determined midpoint Py (the midpoint Py determined last) is defined as the face center Fc.

Figure 1:
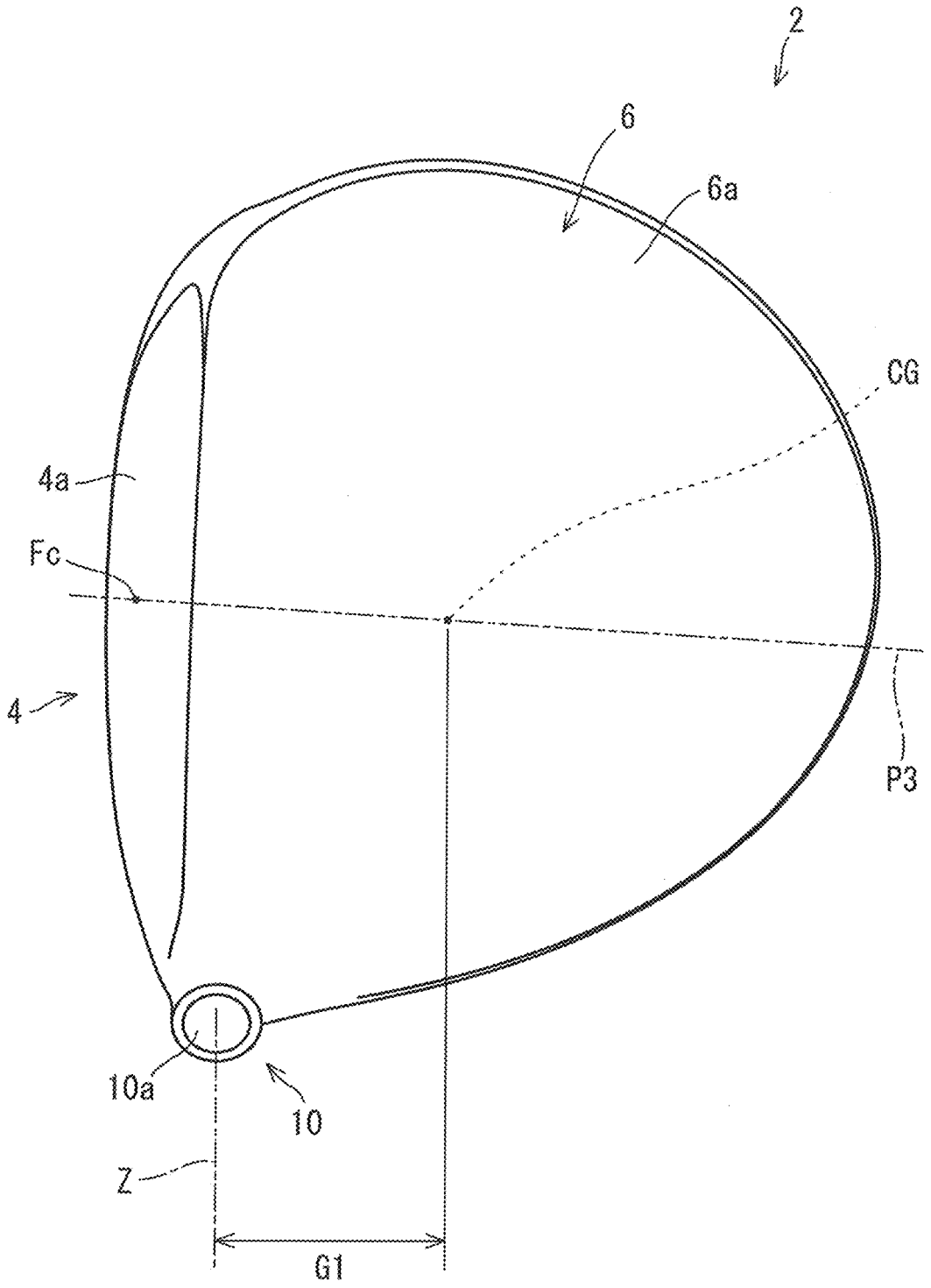
FIG. 1 is a plan view of a golf club head according to a first embodiment.
Figure 2A:
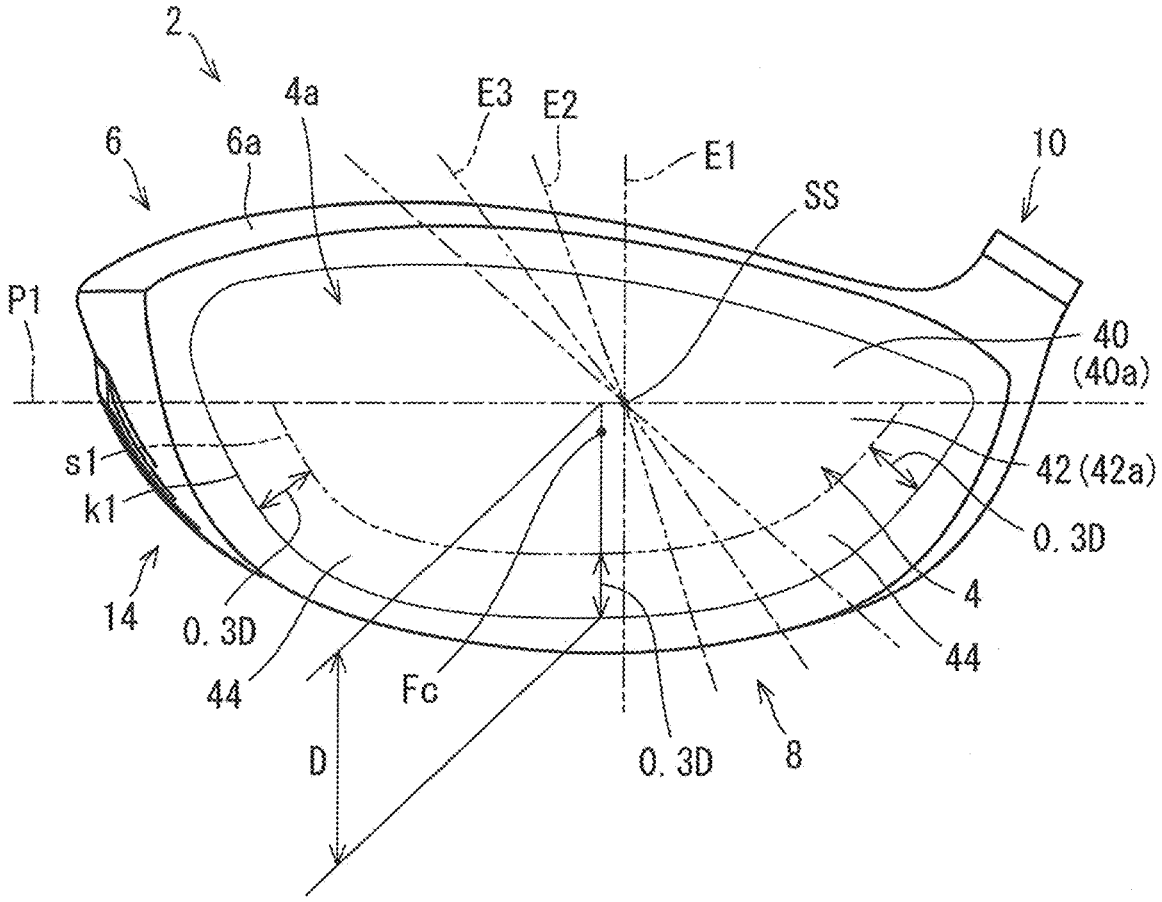
FIG. 2A is a front view of the golf club head in FIG. 1.
Figure 2B:
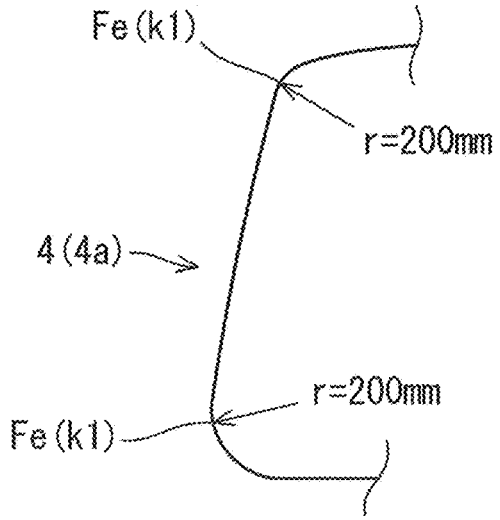
FIG. 2B is a cross-sectional view of the outer surface of the head taken along line E1 in FIG. 2A.

FIG. 1 is a plan view of a golf club head 2 according to a first embodiment. FIG. 2A is a front view of the head 2. FIG. 2B shows a cross section of the head outer surface taken along line E1 in FIG. 2A and is a figure for illustrating a contour line k1 of a striking face.

The head 2 includes a face portion 4, a crown portion 6, a sole portion 8, and a hosel portion 10. The face portion 4 includes a striking face 4*a*. The striking face 4*a* constitutes the outer surface of the face portion 4. The hosel portion 10 has a hosel hole 10*a*. The head 2 is a wood type head. The head 2 is a driver head. The head 2 can be a driver head, a fairway wood type head, or a hybrid type head.

The contour line k1 of the striking face 4*a* can be determined as follows. As shown in FIG. 2A, there can be found a large number of cross sections each of which contains a straight line that connects a head center of gravity CG and a sweet spot SS, for example, cross sections E1, E2, and E3 in FIG. 2A. In each of the cross sections, when a curvature radius of the cross-sectional contour line of the head outer surface is sequentially observed from the sweet spot SS toward the outside of the striking face 4*a*, a point at which the curvature radius becomes 200 mm for the first time is determined as a point Fe (see FIG. 2B). A set of the points Fe can be the contour line k1 of the striking face 4*a*.

Note that the sweet spot SS means an intersection point between the striking face 4*a* and a straight line that passes through the head center of gravity CG and is normal to the striking face 4*a*. In the embodiment of FIG. 2, the sweet spot SS is position on the upper side with respect to the face center Fc. The sweet spot SS is positioned on the heel side with respect to the face center Fc.

Figure 3:
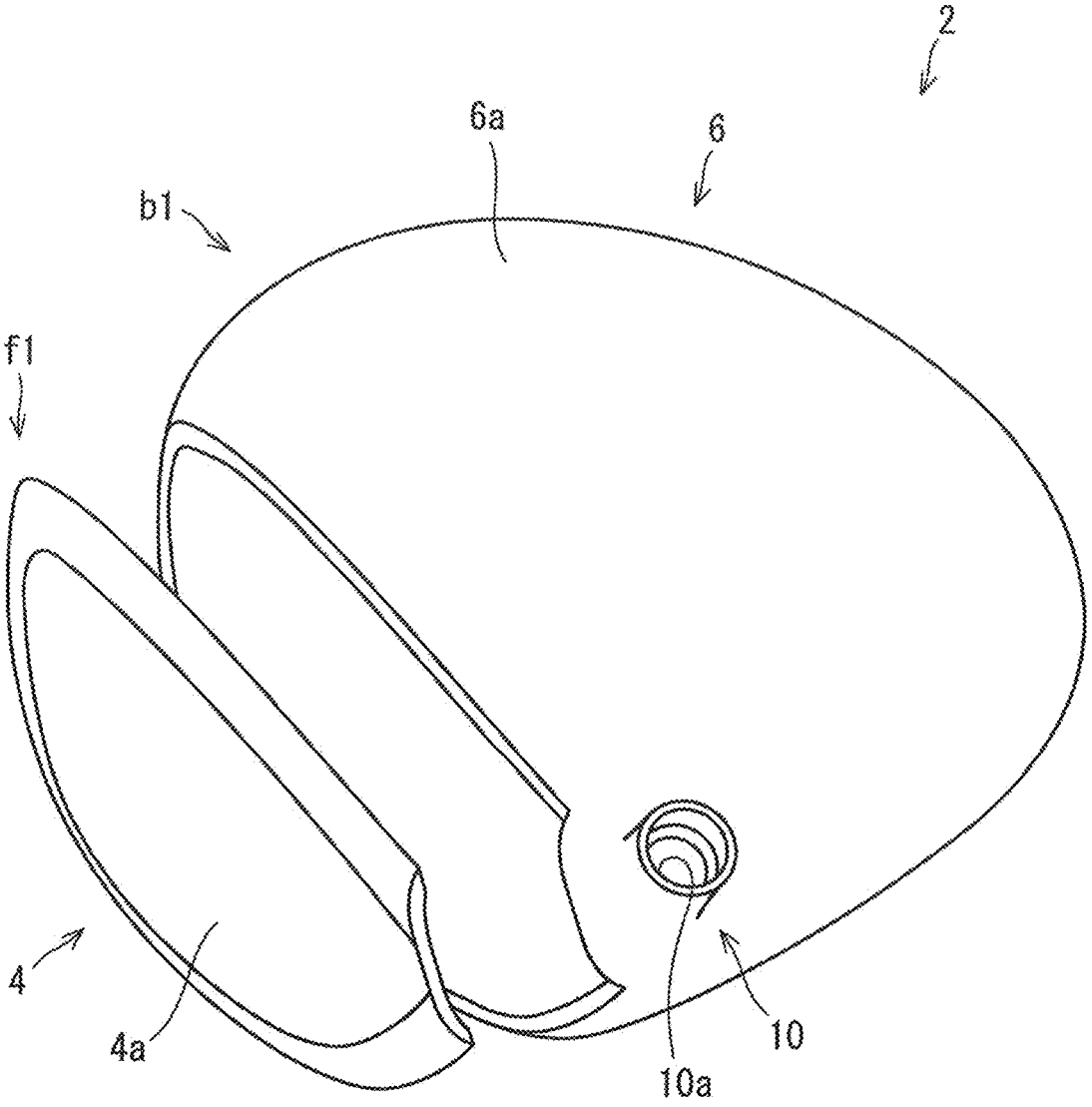
FIG. 3 is an exploded perspective view of the golf club head in FIG. 1.

FIG. 3 is an exploded perspective view of the head 2. The head 2 is formed by joining a face member f1 to a body member b1. This joining is performed by welding. The face member f1 has a cup shape. The face member f1 can be produced by forging, casting, or pressing, for example. From the viewpoint of strength, forging or pressing is preferable. When a wall thickness t4 of a thickest wall portion (discussed below) is large, casting may be more preferable than pressing or forging.

Figure 4:
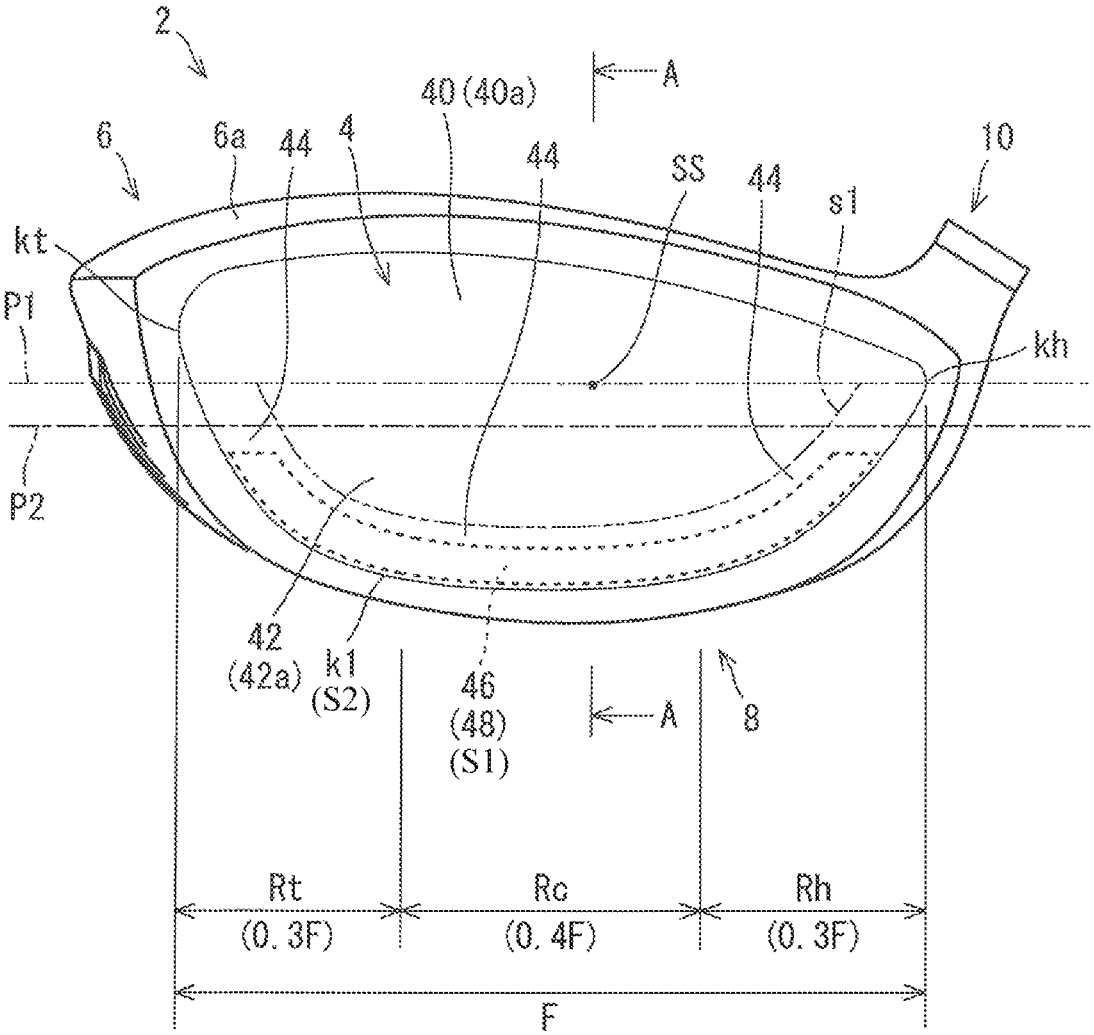
FIG. 4 is a front view of the golf club head in FIG. 1, and shows a thick wall portion formed on the inner surface of a face portion with a dashed line.
Figure 5:
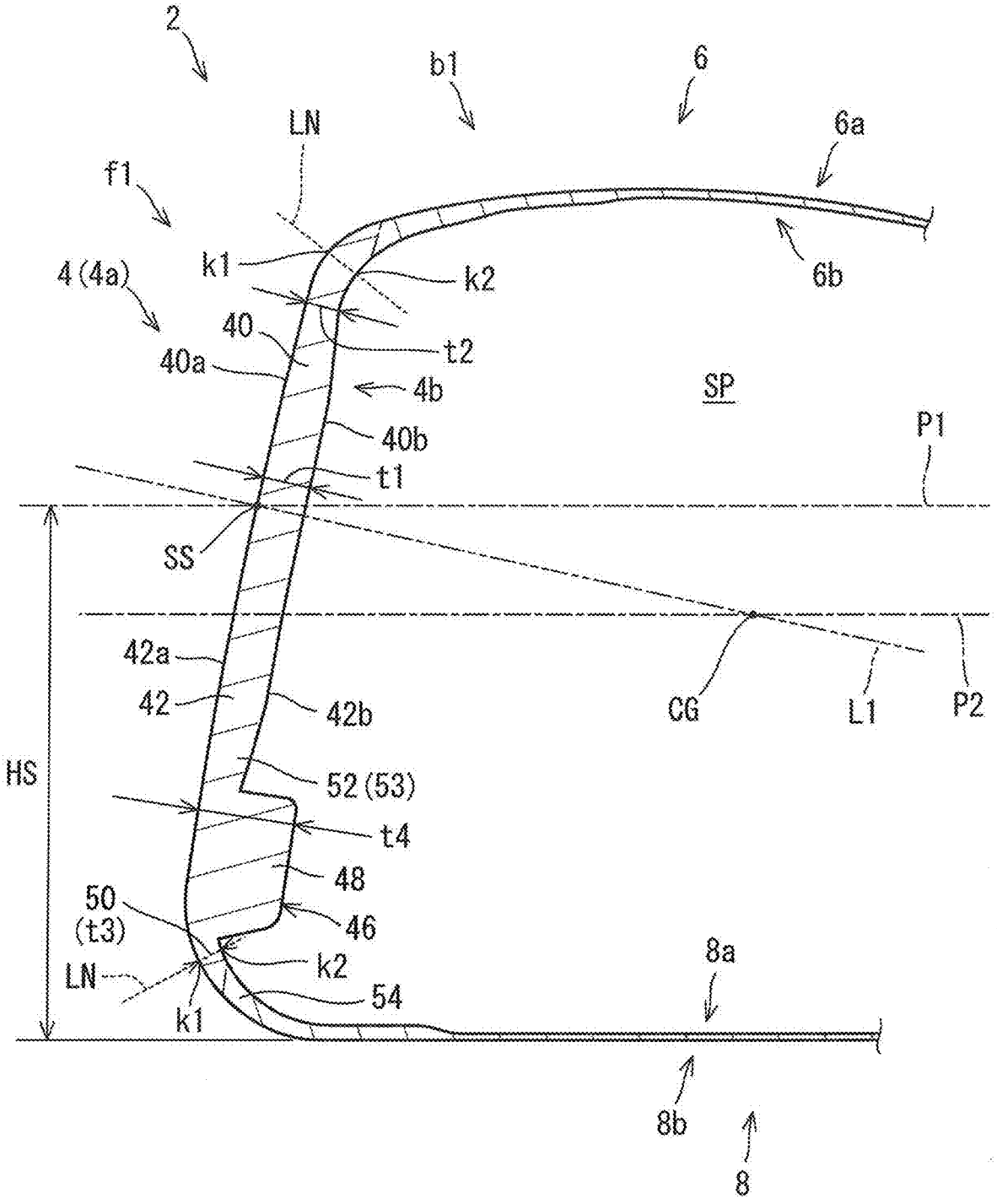
FIG. 5 is a cross-sectional view taken along line A-A in FIG. 4.

FIG. 4 is a front view of the head 2 as with FIG. 2A. FIG. 5 is a cross-sectional view taken along line A-A in FIG. 4. The cross section in FIG. 5 contains the straight line L1 that passes through the sweet spot SS and the head center of gravity CG.

As shown in FIG. 5, the head 2 is hollow. The face portion 4 includes a face outer surface 4*a* and a face inner surface 4*b*. As described above, the face outer surface 4*a* is the striking face. The crown portion 6 includes a crown outer surface 6*a* and a crown inner surface 6*b*. The sole portion 8 includes a sole outer surface 8*a* and a sole inner surface 8*b*. The face inner surface 4*b*, the crown inner surface 6*b* and the sole inner surface 8*b* face a hollow interior SP of the head 2.

As shown in FIG. 5, the face portion 4 includes a contour line k2 on the inner surface (hereinafter, also referred to as an inner surface contour line k2). In a cross section taken in the face-back direction, an intersection point between the head inner surface and a normal line LN that is normal to the head outer surface at a point that constitutes the contour line k1 constitutes the inner surface contour line k2. The normal line LN constitutes the contour of the face portion 4.

As shown in FIG. 4 and FIG. 5, the head 2 has a horizontal plane P1 that passes through the sweet spot SS. In the head 2 which is in the reference state, the horizontal plane P1 is parallel to the ground plane HP. The head 2 also has a horizontal plane P2 that passes through the head center of gravity CG. In the head 2 which is in the reference state, the horizontal plane P2 is parallel to the ground plane HP. The horizontal plane P2 is positioned lower than the horizontal plane P1.

The face portion 4 is divided into an upper part 40 and a lower part 42 by the horizontal plane P1 passing through the sweet spot SS. Of the face portion 4, a part positioned on the upper side of the horizontal plane P1 is the upper part 40. Of the face portion 4, a part positioned on the lower side of the horizontal plane P1 is the lower part 42. Since the face portion 4 is inclined with respect to the horizontal plane P1, a small V-shaped part can be found in the vicinity of the horizontal plane P1 when the face portion 4 is divided by the horizontal plane P1. This division is more precisely described as follows. The face portion 4 is divided into the upper part 40 and the lower part 42 by an intersection line between the striking face 4*a* and the horizontal plane P1 passing through the sweet spot SS. A normal line that is normal to the striking face 4*a* can be defined at each point on the intersection line. A straight line L1 shown in FIG. 5 is an example of the normal line. A set of the normal lines can be a plane that divides the face portion 4 into the upper part 40 and the lower part 42.

Of the striking face 4*a*, a part that is positioned in the upper part 40 is referred to as a face surface upper part 40*a*. Of the striking face 4*a*, a part that is positioned in the lower part 42 is referred to as a face surface lower part 42*a*. Of the face inner surface 4*b*, a part that is positioned in the upper part 40 is referred to as a face inner surface upper part 40*b*. Of the face inner surface 4*b*, a part that is positioned in the lower part 42 is referred to as a face inner surface lower part 42*b*.

The lower part 42 includes a lower peripheral region 44. A double-pointed arrow D in FIG. 2A shows a width of the lower part 42 (face surface lower part 42*a*) in the up-down direction at the position of the face center Fc (hereinafter, a width in the up-down direction is also referred to as an up-down directional width). A width of 30% of the up-down directional width D is also referred to as an offset width. That is, the offset width is 0.3D. In the lower part 42, a region that has a width of the offset width and has a lower contour that coincides with the contour line k1 is the lower peripheral region 44. FIG. 2 shows an offset line s1 with a dot-dot-dash line. The lower peripheral region 44 is a region positioned between the contour line k1 and the offset line s1. A distance between the contour line k1 and the offset line s1 is the offset width, that is, 0.3D. This distance is measured in a direction of a normal line that is normal to the contour line k1 in the front elevation view. The lower peripheral region 44 is determined in the front elevation view.

The lower part 42 includes a thick wall portion 46. The thick wall portion 46 constitutes a protrusion on the face inner surface lower part 42*b*. The thick wall portion 46 has a wall thickness thicker than a maximum wall thickness t1 of the upper part 40. That is, the wall thickness of the thick wall portion 46 is greater than the maximum value t1 of the wall thickness of the upper part 40. Note that the wall thickness of the head 2 including the face portion 4 is measured in a direction of a normal line that is normal to the head outer surface. The direction of the normal line is determined at each point on the head outer surface.

The thick wall portion 46 is disposed inside the inner surface contour line k2. The entirety of the thick wall portion 46 is formed on the face inner surface lower part 42*b*. The entirety of the thick wall portion 46 is formed on the face member f1.

An increase of the weight of the thick wall portion 46 can bring about advantageous effects described below. From this viewpoint, the thick wall portion 46 is defined more preferably as a part that has a wall thickness of greater than or equal to 1.1 times the maximum wall thickness t1 of the upper part 40. The thick wall portion 46 is defined still more preferably as a part that has a wall thickness of greater than or equal to 1.2 times the maximum wall thickness t1 of the upper part 40. The thick wall portion 46 is defined yet more preferably as a part that has a wall thickness of greater than or equal to 1.3 times the maximum wall thickness t1 of the upper part 40. Considering a restriction on the head weight, the wall thickness of the thick wall portion 46 can be less than or equal to 4.0 times the maximum wall thickness t1 of the upper part 40, further can be less than or equal to 3.8 times the maximum wall thickness t1 of the upper part 40, and still further can be less than or equal to 3.6 times the maximum wall thickness t1 of the upper part 40.

The thick wall portion 46 is formed in the lower peripheral region 44. In the present embodiment, the thick wall portion 46 is formed only in the lower peripheral region 44.

The thick wall portion 46 includes a thickest wall portion 48. The thickest wall portion 48 is a part that has a maximum wall thickness in the face portion 4. At least a part of the thick wall portion 46 is the thickest wall portion 48. The entirety of the thick wall portion 46 may be the thickest wall portion 48. In the present embodiment, a large part of the thick wall portion 46 is the thickest wall portion 48. The entirety of the thickest wall portion 48 is disposed in the lower peripheral region 44.

The upper part 40 has a minimum wall thickness t2. The minimum wall thickness t2 is the minimum value of the wall thickness of the upper part 40. The lower part 42 has a minimum wall thickness t3. The minimum wall thickness t3 is the minimum value of the wall thickness of the lower part 42. In the present embodiment, a lower thinnest part 50 whose wall thickness is the minimum wall thickness t3 is positioned on the contour line k1. The lower thinnest part 50 is positioned on the lower side of the thick wall portion 46. The lower thinnest part 50 is positioned between the thick wall portion 46 and the sole portion 8. The minimum wall thickness t3 of the lower part 42 is smaller than the minimum wall thickness t2 of the upper part 40. The lower thinnest part 50 alleviates a hindrance of bending of the face portion 4 caused by the thick wall portion 46, and contributes to improvement in coefficient of restitution. The minimum wall thickness t3 is smaller than the minimum wall thickness t2 in the present embodiment. However, the minimum wall thickness t3 may be greater than the minimum wall thickness t2, or the minimum wall thickness t3 may be equal to the minimum wall thickness t2. From the viewpoint of rebound performance, the minimum wall thickness t2 is preferably greater than the minimum wall thickness t3. From the viewpoint of rebound performance, the minimum wall thickness t3 is preferably the minimum value of the wall thickness of the face portion 4.

Note that the maximum wall thickness t1, the minimum wall thickness t2, and the minimum wall thickness t3 are shown in the cross-sectional view of FIG. 5. Needless to say, the maximum wall thickness t1, the minimum wall thickness t2, and the minimum wall thickness t3 do not have to be present on the cross section on which the head center of gravity CG is present. The positions of the maximum wall thickness t1, the minimum wall thickness t2, and the minimum wall thickness t3 in the toe-heel direction may be different from each other.

As shown in FIG. 4, the thick wall portion 46 continuously extends from a position located on the toe side relative to the sweet spot SS to a position located on the heel side relative to the sweet spot SS. The thick wall portion 46 curvedly extends so as to protrude downward. The entirety of the thick wall portion 46 is disposed in the lower peripheral region 44. The thick wall portion 46 is not present on the upper side of the offset line s1. The thick wall portion 46 is disposed only in the lower peripheral region 44. The thick wall portion 46 is not present on the outside of the lower peripheral region 44. The entirety of the thick wall portion 46 is disposed on the lower side with respect to the head center of gravity CG. That is, the entirety of the thick wall portion 46 is disposed on the lower side with respect to the horizontal plane P2.

A double-pointed arrow F in FIG. 4 shows a length of the face portion 4 (striking face 4*a*). This length is also referred to as a face length. The striking face 4*a* has a toe-most end kt and a heel-most end kh. The face length F is a distance between the end kt and the end kh. The face length F is measured in the toe-heel direction.

As shown in FIG. 4, the face portion 4 is divided into a toe-side region Rt, a heel-side region Rh and a central region Rc. The toe-side region Rt, the heel-side region Rh and the central region Rc are regions in the toe-heel direction.

The toe-side region Rt is a region extending from the toe-most end kt of the face portion 4 and having a length in the toe-heel direction of 30% of the face length F (hereinafter, a length in the toe-heel direction is also referred to as a toe-heel directional length). In other words, the toe-side region Rt is a region that extends from the end kt to a position spaced 30% of the face length F apart from the end kt toward the heel side. The heel-side region Rh is a region extending from the heel-most end kh of the face portion 4 and having a toe-heel directional length of 30% of the face length F. In other words, the heel-side region Rh is a region that extends from the end kh to a position spaced 30% of the face length F apart from the end kh toward the toe side. The central region Rc is a region between the toe-side region Rt and the heel-side region Rh. The central region Rc includes the face center Fc and the sweet spot SS.

The thick wall portion 46 continuously extends from the toe-side region Rt, through the central region Rc, to the heel-side region Rh.

As shown in FIG. 4, the thickest wall portion 48 continuously extends from a position located on the toe side relative to the sweet spot SS to a position located on the heel side relative to the sweet spot SS. The thickest wall portion 48 curvedly extends so as to protrude downward. The entirety of the thickest wall portion 48 is disposed in the lower peripheral region 44. The entirety of the thickest wall portion 48 is disposed on the lower side with respect to the head center of gravity CG. That is, the entirety of the thickest wall portion 48 is disposed on the lower side with respect to the horizontal plane P2. The thickest wall portion 48 continuously extends from the toe-side region Rt, through the central region Rc, to the heel-side region Rh.

As shown in FIG. 5, in the cross section including the sweet spot SS and taken in the face-back direction, the lower part 42 includes an adjoining part 52 that adjoins the upper side of the thick wall portion 46. The adjoining part 52 has a wall thickness smaller than the maximum wall thickness t1. The adjoining part 52 includes a wall thickness varying part 53 that has a wall thickness continuously decreasing from the sweet spot SS side toward the thick wall portion 46. Note that the structure of the adjoining part 52 is not limited. For example, the adjoining part 52 does not have to have a wall thickness varying part and may have a constant wall thickness.

The head 2 includes a sole connection portion 54 that is formed between the thick wall portion 46 and the sole portion 8. The sole connection portion 54 extends from the lower edge of the face portion 4 to the sole portion 8. The sole connection portion 54 curvedly extends so as to protrude toward the outside of the head 2. The wall thickness of the sole connection portion 54 is smaller than the maximum wall thickness t1. The wall thickness of the sole connection portion 54 is smaller than the minimum wall thickness t2. The presence of such a thin sole connection portion 54 alleviates the hindrance of bending of the face portion 4 caused by the thick wall portion 46. The sole connection portion 54 contributes to improvement in coefficient of restitution.

A double-pointed arrow HS in FIG. 5 shows a height of the sweet spot SS. The height HS is a height measured from the ground plane HP when the head 2 is in the reference state. The height HS is measured in the up-down direction. A double-pointed arrow G1 in FIG. 1 shows a depth of the head center of gravity (hereinafter also referred to as a center-of-gravity depth). The center-of-gravity depth G1 is a distance between the shaft axis line Z and the head center of gravity CG. The center-of-gravity depth G1 is measured in the face-back direction. As understood from FIG. 5, since the head 2 has a loft angle, the height HS tends to be lower as the center-of-gravity depth G1 becomes smaller.

Figure 6:
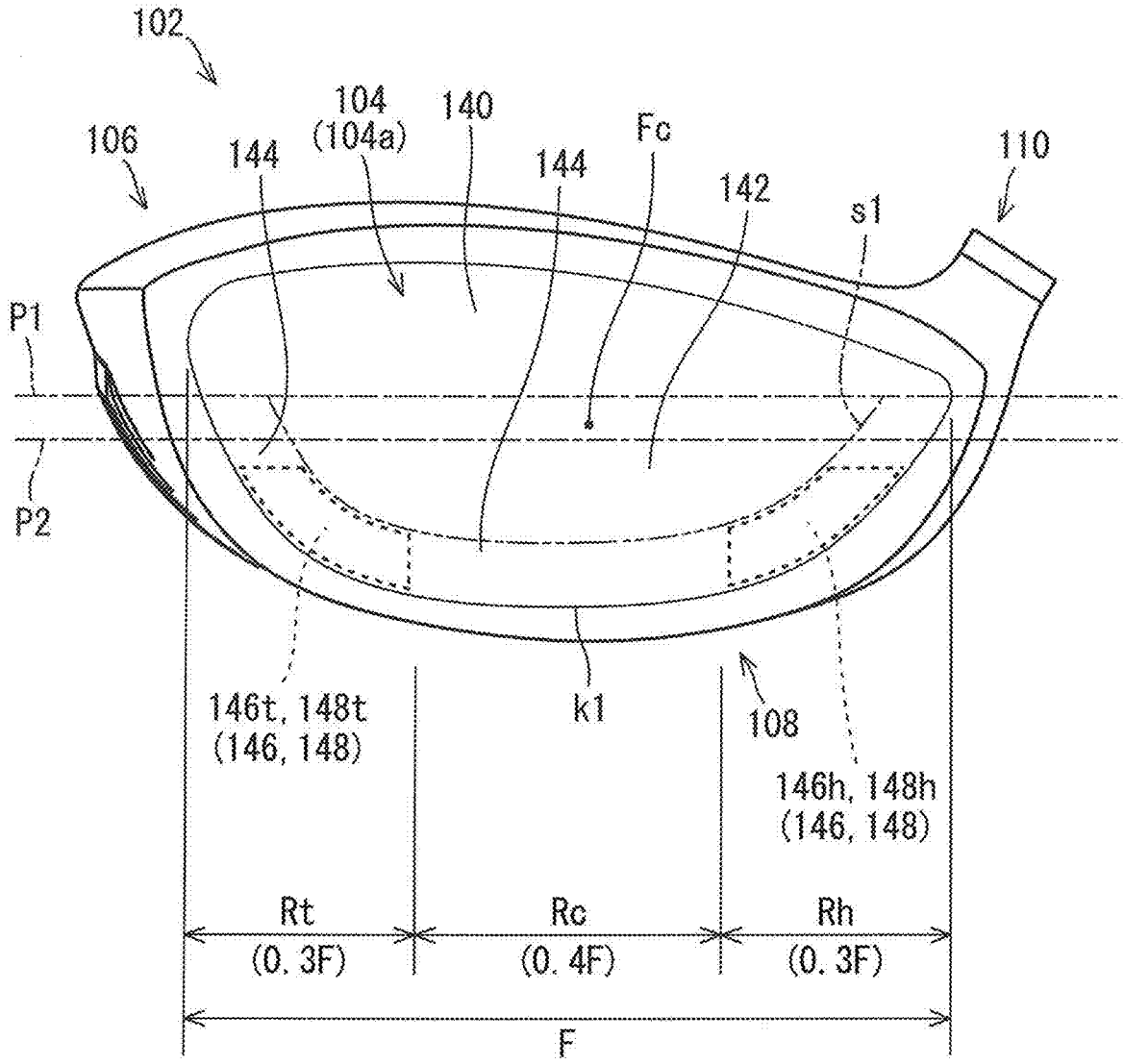
FIG. 6 is a front view of a golf club head according to a second embodiment.

FIG. 6 shows a front view of a golf club head 102 according to a second embodiment. The head 102 includes a face portion 104, a crown portion 106, a sole portion 108, and a hosel portion 110. The outer surface of the face portion 104 is a striking face 104*a*. The face portion 104 includes an upper part 140 and a lower part 142. The lower part 142 includes a lower peripheral region 144 that is bounded by an offset line s1, a contour line k1, and a horizontal plane P1. A thick wall portion 146 is formed in the lower peripheral region 144. The entirety of the thick wall portion 146 is disposed in the lower peripheral region 144. The thick wall portion 146 includes a thickest wall portion 148. The entirety of the thickest wall portion 148 is disposed in the lower peripheral region 144. The entirety of the thick wall portion 146 is disposed on the lower side with respect to a horizontal plane P2. The entirety of the thickest wall portion 148 is disposed on the lower side with respect to the horizontal plane P2. The head 102 has the same configuration as the head 2 of the first embodiment except the form of the thick wall portion.

In the head 102, the thick wall portion 146 is divided into a plurality of parts which are disposed at positions spaced apart from each other. In the head 102, the thick wall portion 146 is divided and separately disposed in a toe-side part and a heel-side part of the face portion 104. The thick wall portion 146 includes a toe thick-wall part 146*t* that is located on the toe side relative to the face center Fc, and a heel thick-wall part 146*h* that is located on the heel side relative to the face center Fc. The heel thick-wall part 146*h* and the toe thick-wall part 146*t* are located apart from each other. The thick wall portion 146 is constituted by the toe thick-wall part 146*t* and the heel thick-wall part 146*h* only. The thick wall portion 146 is not present at the position of the face center Fc in the toe-heel direction. The thick wall portion 146 is not present at the position of the sweet spot SS in the toe-heel direction. The toe thick-wall part 146*t* includes a thickest wall part 148*t*. The heel thick-wall part 146*h* includes a thickest wall part 148*h*. Alternatively, only one of either the toe thick-wall part 146*t* or the heel thick-wall part 146*h* may have a thickest wall portion.

A reference symbol P3 in FIG. 1 shows a plane containing a straight line that passes through the head center of gravity CG and is perpendicular to the striking face 104*a*. In a head which is in the reference state, the plane P3 is perpendicular to the ground plane HP. The toe thick-wall part 146*t* is positioned on the toe side with respect to the plane P3. The heel thick-wall part 146*h* is positioned on the heel side with respect to the plane P3.

The toe thick-wall part 146*t* is disposed in the toe-side region Rt. The entirety of the toe thick-wall part 146*t* is disposed in the toe-side region Rt. The toe thick-wall part 146*t* curvedly extends so as to protrude downward. The heel thick-wall part 146*h* is disposed in the heel-side region Rh. The entirety of the heel thick-wall part 146*h* is disposed in the heel-side region Rh. The heel thick-wall part 146*h* curvedly extends so as to protrude downward. A thick wall portion is not present in the central region Rc.

In the present embodiment, the thick wall portion 146 is divided and separately disposed in the toe-side region Rt and the heel-side region Rh, and is not disposed in the central region Rc. Alternatively, the thick wall portion 146 may be divided and separately disposed in the toe-side region Rt and the heel side region Rh, and may also be separately disposed in the central region Rc. Alternatively, the thick wall portion 146 may be disposed neither in the heel-side region Rh nor in the central region Rc, and may be disposed in the toe-side region Rt only. Further alternatively, the thick wall portion 146 may be disposed neither in the toe-side region Rt nor in the central region Rc, and may be disposed in the heel-side region Rh only.

Figure 7:
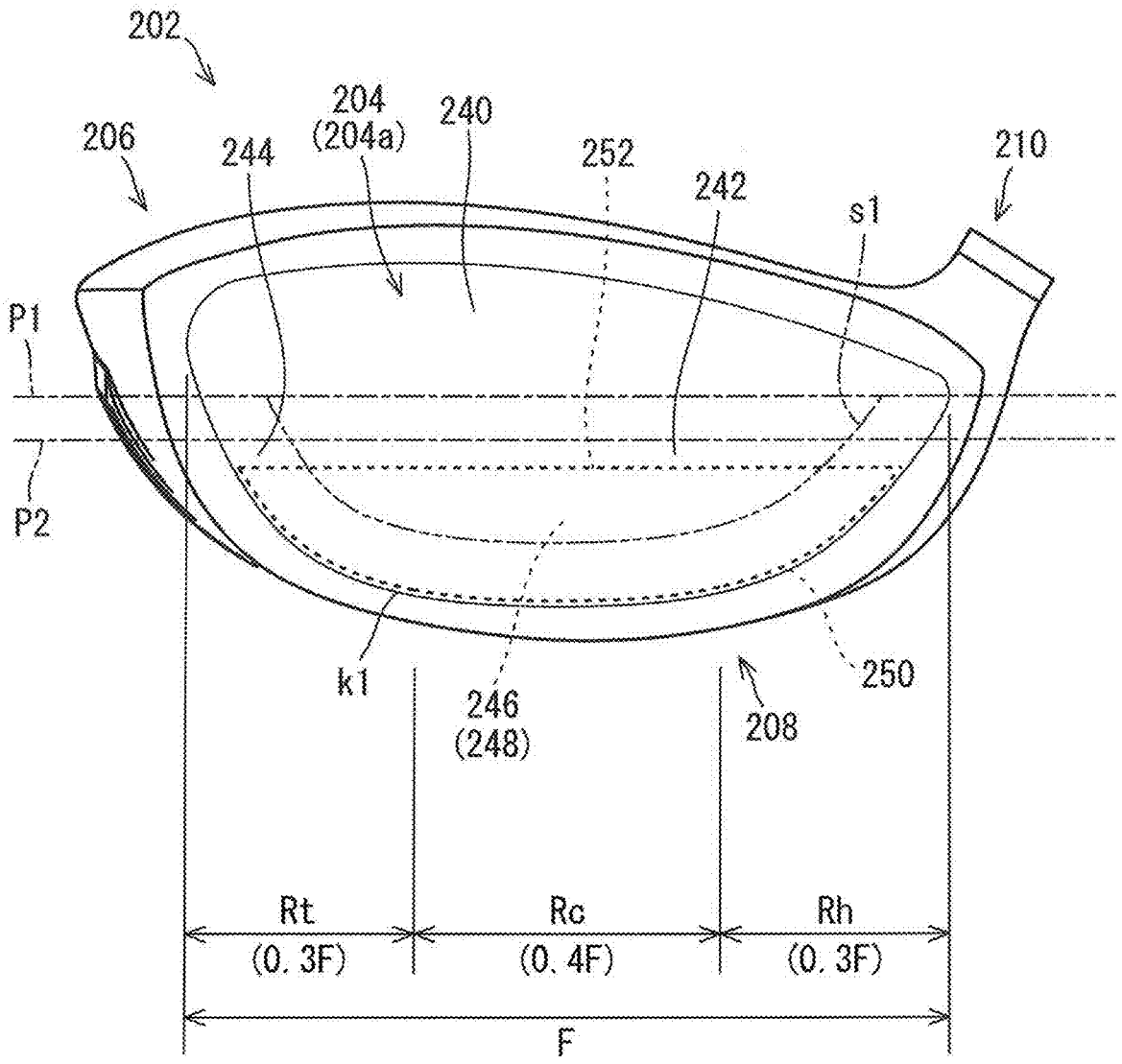
FIG. 7 is a front view of a golf club head of a reference example.

FIG. 7 is a front view of a golf club head 202 according to a reference example. The head 202 includes a face portion 204, a crown portion 206, a sole portion 208 and a hosel portion 210. The face portion 204 includes an upper part 240 and a lower part 242. The lower part 242 includes a lower peripheral region 244 that is bounded by an offset line s1, a contour line k1 and a horizontal plane P1. A thick wall portion 246 is formed in the lower peripheral region 244. A part of the thick wall portion 246 is disposed in the lower peripheral region 244. A part of the thick wall portion 246 is disposed on the outside of the lower peripheral region 244. The thick wall portion 246 includes a thickest wall portion 248. The entirety of the thick wall portion 246 is disposed on the lower side with respect to a horizontal plane P2. The head 202 has the same configuration as the head 2 of the first embodiment except the form of the thick wall portion.

In the head 202, the thick wall portion 246 extends to the outside of the lower peripheral region 244. A lower edge 250 of the thick wall portion 246 extends along the contour line k1 of a striking face 204*a*. The lower edge 250 curves so as to protrude downward. An upper edge 252 of the thick wall portion 246 extends straightly along the horizontal plane P2.

The thick wall portion 246 extends to the outside of the lower peripheral region 244. The thick wall portion 246 includes a part that is located in the lower peripheral region 244, and a part that is located on the upper side of the offset line s1. In the toe-side region Rt, the thick wall portion 246 includes a part that is located on the upper side of the offset line s1. In the central region Rc, the thick wall portion 246 includes a part that is located on the upper side of the offset line s1. In the heel-side region Rh, the thick wall portion 246 includes a part that is located on the upper side of the offset line s1.

The head 2 of the first embodiment and the head 102 of the second embodiment described above exhibit the following advantageous effects.

The thick wall portion can hinder the face portion 4 from bending at impact with a golf ball. In the head 2 of the first embodiment, however, the thick wall portion 46 is provided only in the lower peripheral region 44. This alleviates the hindrance of bending of the face portion 4. In addition, since the thick wall portion 46 is provided in the lower-side part of the face portion 4, the head 2 has a head center of gravity CG located at a lower position and has a small center-of-gravity depth G1. As a result, the height HS of the sweet spot SS is lowered, and actual golf ball impact points on the striking face become closer to the sweet spot SS (hereinafter, golf ball impact points on the striking face are also simply referred to as impact points). The sweet spot SS is shifted from a position spaced apart upward from impact points to a position closer to impact points, which reduces a vertical gear effect and brings about a lower backspin rate. Particularly when the head strikes a ball with a high launch angle, such a lower backspin rate contributes to increase in flight distance.

Note that actual impact points are distributed mainly at and around the face center Fc. Accordingly, the face center Fc can be considered as an actual impact point having the highest probability of impact with a golf ball.

The presence of the thick wall portion 46 can reduces the degree of bending of the face portion 4 as compared with a head having no thick wall portion 46. The sweet spot SS, however, is located closer to impact points, which improves coefficient of restitution at actual impact points.

The entirety of the thick wall portion 46 is positioned on the lower side with respect to the head center of gravity CG. Accordingly, the advantageous effect of lowering the position of the sweet spot SS is enhanced.

Thus, the head 2 can increase flight distance for golfers who should strike a ball with a lower backspin rate, such as golfers who strike a ball at a high launch angle.

The same advantageous effects as in the head 2 are exhibited also in the head 102 of the second embodiment. In addition, in the head 102, the thick wall portion 146 is not formed in the central part of the face portion 104. This further alleviates the hindrance of bending of the face portion 104 caused by the thick wall portion 146, and increases the coefficient of restitution in the central part of the face portion 104. Furthermore, the weight of the thick wall portion 146 is separately allocated to the toe-side part and the heel-side part of the face portion 104, which increases the lateral moment of inertia of the head 102. The increase of the lateral moment of inertia contributes to stabilizing the trajectory of the struck ball and enlarging an area having a high rebound performance. From the viewpoint of lowering the position of the sweet spot SS, the head 2 is more effective than the head 102. Note that the lateral moment of inertia means a moment of inertia about an axis that passes through the head center of gravity CG and is parallel to the up-down direction. The unit of the moment of inertia is $g \cdot cm^2$. The moment of inertia can be measured using MODEL NUMBER RK/005-002 manufactured by INERTIA DYNAMICS, for example.

A double-pointed arrow t4 in FIG. 5 is the wall thickness of the thickest wall portion 48. From the viewpoint of enhancing the advantageous effects brought by the thick wall portion 46, the wall thickness t4 of the thickest wall portion 48 is preferably greater than or equal to 3.00 times the minimum wall thickness t2 of the upper part 40, more preferably greater than or equal to 3.25 times the minimum wall thickness t2 of the upper part 40, and still more preferably greater than or equal to 3.50 times the minimum wall thickness t2 of the upper part 40. From the viewpoint of a restriction on the head weight, the wall thickness t4 is preferably less than or equal to 6.50 times the minimum wall thickness t2, more preferably less than or equal to 6.25 times the minimum wall thickness t2, and still more preferably less than or equal to 6.00 times the minimum wall thickness t2.

The presence of the thick wall portion can reduce the center-of-gravity depth G1, and locate the sweet spot SS at a position closer to the impact points. From this viewpoint, the center-of-gravity depth G1 is preferably less than or equal to 22 mm, more preferably less than or equal to 20 mm, and still more preferably less than or equal to 18 mm. From the viewpoint of limitations on the head shape of a wood type head or a hybrid type head, the center-of-gravity depth G1 is preferably greater than or equal to 6 mm, more preferably greater than or equal to 8 mm, and still more preferably greater than or equal to 10 mm.

From the viewpoint of locating the sweet spot SS at a position closer to the impact points, the height HS of the sweet spot SS is preferably less than or equal to 36 mm, more preferably less than or equal to 34 mm, and still more preferably less than or equal to 32 mm. From the viewpoint of limitations on the head shape of a wood type head or a hybrid type head, the height HS of the sweet spot SS is preferably greater than or equal to 18 mm, more preferably greater than or equal to 19 mm, and still more preferably greater than or equal to 20 mm.

From the viewpoint of reducing the height HS of the sweet spot SS to locate the sweet spot SS at a position closer to the impact points, the height of the head center of gravity CG is preferably less than or equal to 33 mm, more preferably less than or equal to 31 mm, and still more preferably less than or equal to 29 mm. From the viewpoint of limitations on the head shape of a wood type head or a hybrid type head, the height of the head center of gravity CG is preferably greater than or equal to 11 mm, more preferably greater than or equal to 12 mm, and still more preferably greater than or equal to 13 mm. The height of the head center of gravity CG is a height measured from the ground plane HP when the head 2 is in the reference state. This height is measured in the up-down direction.

A head having a large volume tends to have a large center-of-gravity depth G1. Accordingly, the advantageous effects brought by the thick wall portion are enhanced in such a head. From this viewpoint, the head volume is preferably greater than or equal to 400 $cm^3$, more preferably greater than or equal to 410 $cm^3$, and still more preferably greater than or equal to 420 $cm^3$. From the viewpoint of the rules of golf, the head volume is preferably less than or equal to 470 $cm^3$, more preferably less than or equal to 465 $cm^3$, and still more preferably less than or equal to 460 $cm^3$.

In the above-described embodiments, the coefficient of restitution is prevented from lowering although the thick wall portion is provided in the face portion. From this viewpoint, a COR at the face center Fc is preferably greater than or equal to 0.820, more preferably greater than or equal to 0.821, and still more preferably greater than or equal to 0.822. An excessively high COR can reduce the strength of the face portion. From this viewpoint, the COR at the face center Fc is preferably less than or equal to 0.870, more preferably less than or equal to 0.865, and still more preferably less than or equal to 0.860.

The word "COR" stands for Coefficient of Restitution. The COR is measured in accordance with the regulation shown in Procedure for Measuring the Velocity Ratio of a Club Head for Conformance to Rule 4-1e, Revision 2 (Feb. 8, 1999) specified by the USGA. This measuring method is specifically as shown below. A golf ball (Pinnacle Gold golf ball) manufactured by Titleist Corporate is launched from a position 1 m apart from a head at a speed of 160 feet (48.77 m/s) by using a ball launcher to collide the ball with the face center Fc of the head which is placed on a stand and is not fixed to the stand. Velocity sensors are set at a position spaced 13 inches (330.2 mm) apart from the head and at a position spaced 25 inches (635 mm) apart from the head to measure velocities of the ball rebounded from the head with the two sensors, and then a coefficient of restitution e is calculated from a formula shown below. This coefficient of restitution e is COR.

$$(Vo/Vi)=(eM-m)/(M+m)$$

Vi denotes a velocity (=48.77 m/s) of the golf ball before colliding with the head, Vo denotes a velocity of the golf ball rebounded from the head, M denotes the weight of the head, and m denotes the weight of the golf ball.

In the front elevation view, as shown in FIG. 4, a projected area of the thick wall portion is denoted by S1, and a projected area of the striking face is denoted by S2. From the viewpoint of increasing the weight of the thick wall portion, S1/S2 is preferably greater than or equal to 5%, more preferably greater than or equal to 8%, and still more preferably greater than or equal to 10%. From the viewpoint of disposing the thick wall portion in the lower peripheral region only, S1/S2 is preferably less than or equal to 45%, more preferably less than or equal to 42%, and still more preferably less than or equal to 40%. From the same view point, S1/S2 can be set to be less than or equal to 30%, further set to be less than or equal to 25%, and still further set to be less than or equal to 20%.

In the front elevation view, the projected area of the thick wall portion is denoted by S1, and a projected area of the lower part of the face portion is denoted by S3. From the viewpoint of increasing the weight of the thick wall portion, S1/S3 is preferably greater than or equal to 20%, more preferably greater than or equal to 25%, and still more preferably greater than or equal to 30%. From the viewpoint of disposing the thick wall portion in the lower peripheral region only, S1/S3 is preferably less than or equal to 70%, more preferably less than or equal to 65%, and still more preferably less than or equal to 60%.

Figure 8A:
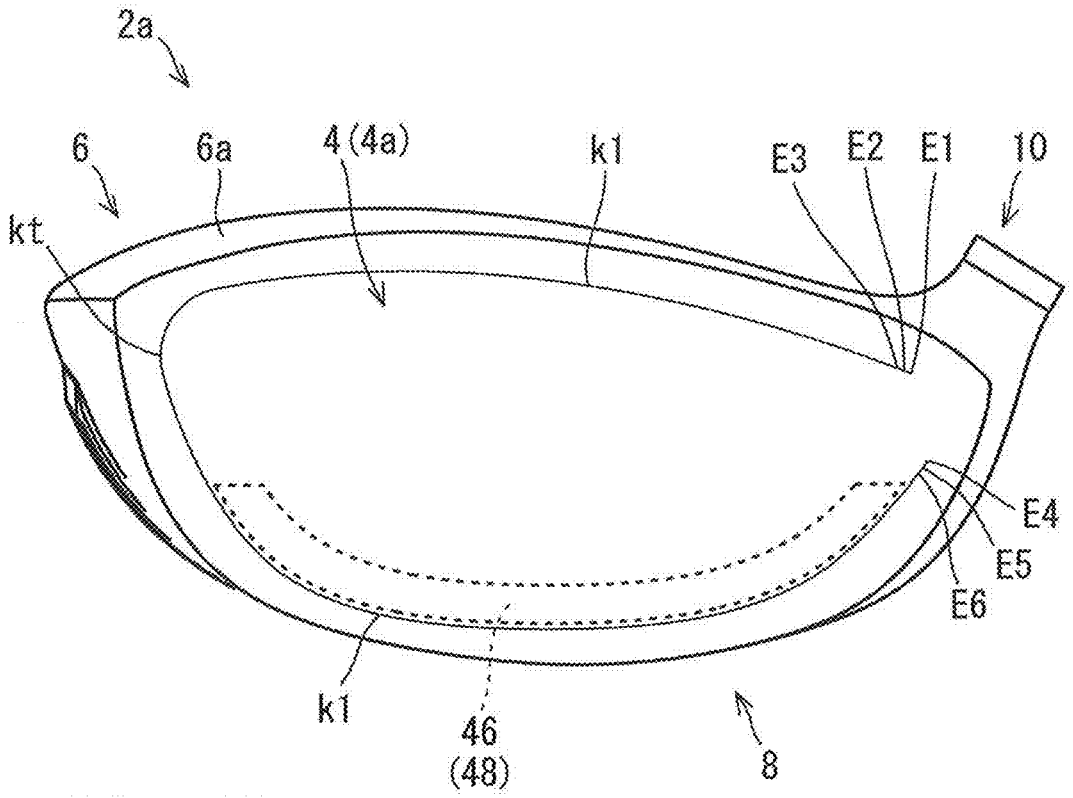
FIG. 8A is a front view of a golf club head of a modification example of the first embodiment.
Figure 8B:
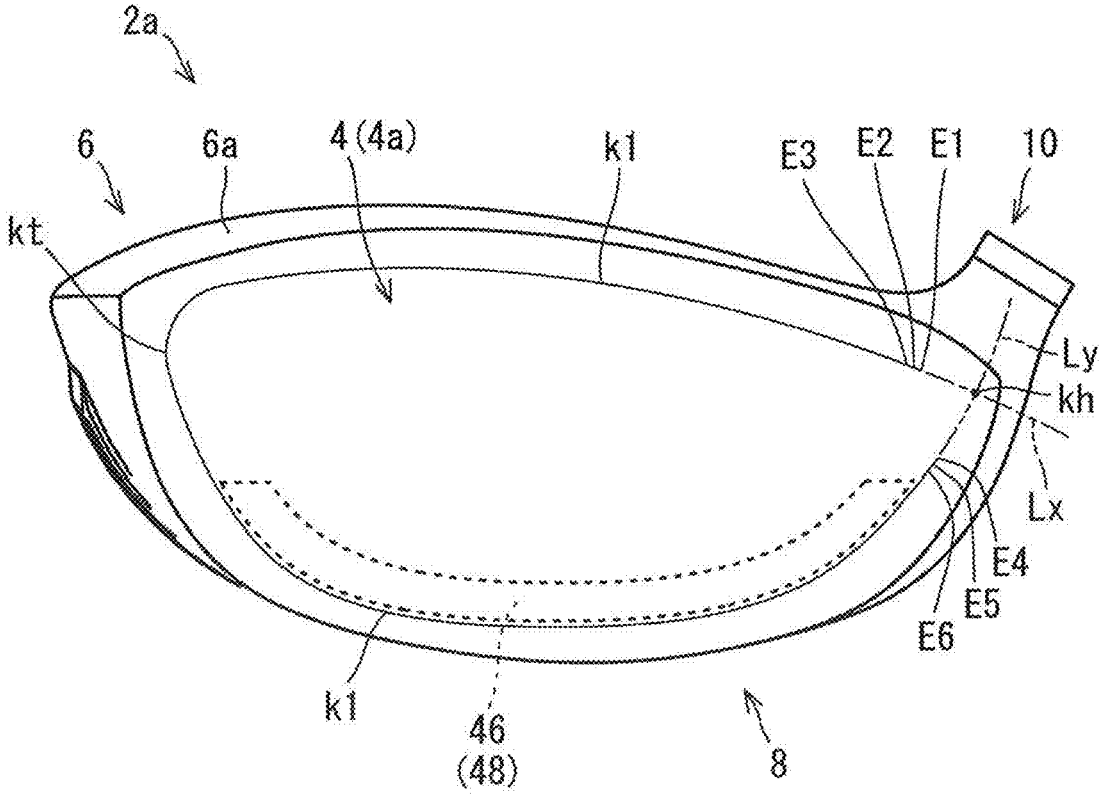
FIG. 8B illustrates extended lines for a head in which a contour line of its striking face has a gap.

FIG. 8A is a front view of a head 2*a* that is a modification example of the head 2. Unlike the head 2, in the head 2*a*, the contour like k1 which is defined as described above has a gap on the heel side of the face portion 4. In such a case, an extended line Lx and an extended line Ly of the contour line k1 are determined in the front elevation view as shown below. At a first end part of the gap of the contour line k1, an end point E1, a point E2 spaced 0.5 mm apart from the end point E1, and a point E3 spaced 0.5 mm apart from the point E2 are determined. Similarly, at a second end part of the gap of the contour line k1, an end point E4, a point E5 spaced 0.5 mm apart from the end point E4, and a point E6 spaced 0.5 mm apart from the point E6 are determined. "0.5 mm" for these points are a route distance measured on the contour line k1 (not a straight distance). An arc of a circle that passes through the three points E1, E2 and E3 is the extended line Lx. When the three points E1, E2 and E3 are positioned on a straight line, the extended line Lx is the straight line. An arc of a circle that passes through the three points E4, E5 and E6 is the extended line Ly. When the three points E4, E5 and E6 are positioned on a straight line, the extended line Ly is the straight line. An intersection point between the extended line Lx and the extended line Ly can be the heel-most end kh of the striking face 4*a*. When the contour line k1 has a gap on the toe side of the face portion 4, the end kt can be determined in the same manner. The extended lines can be defined even when the contour line k1 has a gap at any position. When the contour line k1 has a gap, the projected area S2 of the striking face 4*a* can be determined by the extended lines and the contour line k1.

EXAMPLES

Example 1

A head of Example 1 was the same as the above-described head 2 (see FIG. 4) of the first embodiment. A Ti-8Al-2V was cast to obtain a body member b1. A Ti-6Al-4V was forged to obtain a face member f1. The face member f1 was welded to the body member b1 to obtain the head of Example 1 which had the same configuration as the head 2. A shaft and a grip were attached to the head to obtain a club of Example 1. The head volume was 460 $cm^3$. The loft angle was 10.5°. The club length was 45.5 inches.

Example 2

A head of Example 2 was the same as the above-described head 102 (see FIG. 6) of the second embodiment. The head of Example 2 which had the same configuration as the head 102 and a club having the head were obtained in the same manner as in Example 1 except that the configuration of the thick wall portion was different from that of Example 1.

Comparative Example 1

A head of Comparative Example 1 was the same as the above-described head 202 (see FIG. 7) of the reference example. The head of Comparative Example 1 which had the same configuration as the head 202 and a club having the head were obtained in the same manner as in Example 1 except that the configuration of the thick wall portion was different from that of Example 1.

Comparative Example 2

A head of Comparative Example 2 and a club having the head were obtained in the same manner as in Example 1 except that the head had no thick wall portion.

Note that the thick wall portions of Example 1, Example 2 and Comparative Example 1 had the same volume and the same weight. All Examples and all Comparative Examples had the same head weight. The face portions of all Examples and all Comparative Examples also had the same weight. In Comparative Example 2, the wall thickness of the entire face portion (except the minimum wall thickness t3 and its vicinity) is uniformly increased from a face portion in which the thick wall portion 46 is removed from the face portion of Example 1 so that the face portion of Comparative Example 2 had the same weight as those of Example 1, Example 2 and Comparative Example 1. However, the minimum wall thickness t3 of Comparative Example 2 was the same as those of Example 1, Example 2 and Comparative Example 1.

[Evaluations]

COR at the face center Fc of each of the heads was measured in the above-described manner. In addition, each golf club was attached to a swing robot manufactured by TRUE TEMPER SPORTS, INC., and the swing robot struck balls at the face center Fc of the club with a head speed of 45 m/s to measure flight distances of the struck balls.

Specifications and evaluation results of Examples and Comparative Examples are shown in below Table 1.

TABLE 1

Specifications and evaluation results of Examples and Comparative Examples

| | Unit | Example 1 | Example 2 | Comparative Example 1 | Comparative Example 2 |
|---|---|---|---|---|---|
| Corresponding figure | — | FIG. 4 | FIG. 6 | FIG. 7 | — |
| Head volume | $cm^3$ | 460 | 460 | 460 | 460 |
| Head weight | gram | 196 | 196 | 196 | 196 |
| Maximum wall thickness t1 of the upper part | mm | 1.8 | 1.8 | 1.8 | 2.4 |
| Minimum wall thickness t2 of the upper part | mm | 1.0 | 1.0 | 1.0 | 1.6 |
| Minimum wall thickness t3 of the lower part | mm | 0.9 | 0.9 | 0.9 | 0.9 |
| Wall thickness t4 of the thickest wall portion | mm | 3.6 | 5.8 | 2.9 | 2.4 |
| t4/t2 | — | 3.6 | 5.8 | 2.9 | 1.5 |
| t4/t1 | — | 2.0 | 3.2 | 1.6 | 1.0 |
| Center-of-gravity depth G1 | mm | 16.0 | 16.2 | 16.0 | 16.5 |
| Height HS of the sweet spot SS | mm | 31.8 | 32.0 | 32.6 | 33.1 |
| Lateral moment of inertia of the head | $g \cdot cm^2$ | 4800 | 4920 | 4840 | 4860 |
| COR | — | 0.832 | 0.832 | 0.830 | 0.829 |
| Flight distance | yard | 261.2 | 261.1 | 260.6 | 259.8 |

As shown in Table 1, Examples 1 and 2 are highly evaluated as compared with Comparative Examples 1 and 2.

The following clauses are a part of invention included in the present disclosure.

[Clause 1]

A golf club head including:

a face portion that includes a striking face;

a sole portion;

a crown portion;

a hosel portion; and a head center of gravity, wherein the striking face includes a face center and a sweet spot that is an intersection point between the striking face and a straight line that passes through the head center of gravity and is perpendicular to the striking face, when the face portion is divided into an upper part and a lower part by a horizontal plane that passes through the sweet spot, the lower part includes a thick wall portion that has a wall thickness greater than a maximum wall thickness of the upper part, at least a part of the thick wall portion is a thickest wall portion that has a maximum wall thickness in the face portion, and when a width of 30% of an up-down directional width of the lower part at a position of the face center is referred to as an offset width, and, of the lower part, a region that has a width of the offset width and has a lower contour coinciding with a contour line of the striking face is defined as a lower peripheral region, then an entirety of the thick wall portion is disposed in the lower peripheral region.

[Clause 2]

The golf club head according to clause 1, wherein the thickest wall portion has a wall thickness of greater than or equal to 3.0 times a minimum wall thickness of the upper part.

[Clause 3]

The golf club head according to clause 1 or 2, wherein the entirety of the thick wall portion is disposed on a lower side with respect to the head center of gravity.

[Clause 4]

The golf club head according to any one of clauses 1 to 3, wherein the thick wall portion is divided and separately disposed in a toe-side part and a heel-side part of the face portion.

[Clause 5]

The golf club head according to clause 4, wherein when the face portion is divided into a toe-side region that extends from a toe-most end of the face portion and has a toe-heel directional length of 30% of a face length, a heel-side region that extends from a heel-most end of the face portion and has a toe-heel directional length of 30% of the face length, and a central region that is located between the toe-side region and the heel-side region, then the thick wall portion is divided into a toe thick-wall part that is disposed in the toe-side region and a heel thick-wall part that is disposed in the heel-side region, and the thick wall portion is not present in the central region.

[Clause 6]

The golf club head according to any one of clauses 1 to 3, wherein when the face portion is divided into a toe-side region that extends from a toe-most end of the face portion and has a toe-heel directional length of 30% of a face length, a heel-side region that extends from a heel-most end of the face portion and has a toe-heel directional length of 30% of the face length, and a central region that is located between the toe-side region and the heel-side region, then the thick wall portion extends from the toe-side region through the central region to the heel-side region.

LIST OF REFERENCE SYMBOLS

2, 2*a*, 102, 202 Golf club head
4, 104, 204 Face portion
4*a*, 104*a*, 204*a* Striking face
6, 106, 206 Crown portion
8, 108, 208 Sole portion
10, 110, 210 Hosel portion
40, 140, 240 Upper part of the face portion
42, 142, 242 Lower part of the face portion
44, 144, 244 Lower peripheral region
46, 146, 246 Thick wall portion
48, 148, 248 Thickest wall portion
s1 Offset line
k1 Contour line of the striking face
CG Head center of gravity
SS Sweet spot
Fc Face center
P1 Horizontal plane passing through the sweet spot
P2 Horizontal plane passing through the head center of gravity The above descriptions are merely illustrative and various modifications can be made without departing from the principles of the present disclosure.

The terminology used in the description of the various described embodiments herein is for the purpose of describing particular embodiments only and is not intended to be limiting. The use of the terms "a", "an", "the", and similar referents in the context of throughout this disclosure (especially in the context of the following claims) are to be construed to cover both the singular and the plural, unless otherwise indicated herein or clearly contradicted by context. As used throughout this disclosure, the word "may" is used in a permissive sense (i.e., meaning "having the potential to"), rather than the mandatory sense (i.e., meaning "must"). Similarly, as used throughout this disclosure, the terms "comprising," "having," "including," and "containing" are to be construed as open-ended terms (i.e., meaning "including, but not limited to,") unless otherwise noted.

What is claimed is:

1. A golf club head comprising:

a face portion that includes a striking face;

a sole portion;

a crown portion;

a hosel portion; and a head center of gravity, wherein the striking face includes a face center and a sweet spot that is an intersection point between the striking face and a straight line that passes through the head center of gravity and is perpendicular to the striking face, when the face portion is divided into an upper part and a lower part by a horizontal plane that passes through the sweet spot, the lower part includes a thick wall portion that has a wall thickness greater than a maximum wall thickness of the upper part, at least a part of the thick wall portion is a thickest wall portion that has a maximum wall thickness in the face portion, the golf club head further includes a sole connection portion formed between the thick wall portion and the sole portion, the sole connection portion has a wall thickness smaller than the maximum wall thickness of the upper part, and when a width of 30% of an up-down directional width of the lower part at a position of the face center is referred to as an offset width, and, of the lower part, a region that has a width of the offset width and has a lower contour coinciding with a contour line of the striking face is defined as a lower peripheral region, then an entirety of the thick wall portion is disposed in the lower peripheral region.

2. The golf club head according to claim 1, wherein the thickest wall portion has a wall thickness of greater than or equal to 3.0 times a minimum wall thickness of the upper part.

3. The golf club head according to claim 1, wherein the entirety of the thick wall portion is disposed on a lower side with respect to the head center of gravity.

4. The golf club head according to claim 1, wherein the thick wall portion is divided and separately disposed in a toe-side part and a heel-side part of the face portion.

5. The golf club head according to claim 1, wherein when the face portion is divided into a toe-side region that extends from a toe-most end of the face portion and has a toe-heel directional length of 30% of a face length, a heel-side region that extends from a heel-most end of the face portion and has a toe-heel directional length of 30% of the face length, and a central region that is located between the toe-side region and the heel-side region, then the thick wall portion extends from the toe-side region through the central region to the heel-side region.

6. The golf club head according to claim 1, wherein the wall thickness of the thick wall portion is less than or equal to 4.0 times the maximum wall thickness of the upper part.

7. The golf club head according to claim 4, wherein a boundary between the toe-side part and the heel-side part is a plane, the plane being perpendicular to a ground plane and containing the straight line that is perpendicular to the striking face and that passes through the head center of gravity.

8. The golf club head according to claim 1, wherein the thick wall portion is an entirety of a region having a wall thickness greater than the maximum wall thickness of the upper part, when the up-down directional width of the lower part at the position of the face center is denoted by D, and 30% of the up-down directional width D is denoted by 0.3D, then the offset width is equal to 0.3D, a line that extends parallel to the contour line of the striking face in the lower part and has a distance of the offset width from the contour line of the striking face is defined as an offset line, the lower peripheral region is located between the offset line and the contour line of the striking face, and the thick wall portion is not present above the offset line.

9. The golf club head according to claim 1, wherein the wall thickness of the sole connection portion is smaller than a minimum wall thickness of the upper part.

10. The golf club head according to claim 1, wherein the sole connection portion curvedly extends to protrude toward outside of the golf club head.

11. A golf club head comprising:

a face portion that includes a striking face;

a sole portion;

a crown portion;

a hosel portion; and a head center of gravity, wherein the striking face includes a face center and a sweet spot that is an intersection point between the striking face and a straight line that passes through the head center of gravity and is perpendicular to the striking face, when the face portion is divided into an upper part and a lower part by a horizontal plane that passes through the sweet spot, the lower part includes a thick wall portion that has a wall thickness greater than a maximum wall thickness of the upper part, at least a part of the thick wall portion is a thickest wall portion that has a maximum wall thickness in the face portion, when a width of 30% of an up-down directional width of the lower part at a position of the face center is referred to as an offset width, and, of the lower part, a region that has a width of the offset width and has a lower contour coinciding with a contour line of the striking face is defined as a lower peripheral region, then an entirety of the thick wall portion is disposed in the lower peripheral region, the thick wall portion is divided and separately disposed in a toe-side part and a heel-side part of the face portion, when the face portion is divided into a toe-side region that extends from a toe-most end of the face portion and has a toe-heel directional length of 30% of a face length, a heel-side region that extends from a heel-most end of the face portion and has a toe-heel directional length of 30% of the face length, and a central region that is located between the toe-side region and the heel-side region, then the thick wall portion is divided into a toe thick-wall part that is disposed in the toe-side region and a heel thick-wall part that is disposed in the heel-side region, and the thick wall portion is not present in the central region.

12. A golf club head comprising:

a face portion that includes a striking face;

a sole portion;

a crown portion;

a hosel portion; and a head center of gravity, wherein the striking face includes a face center and a sweet spot that is an intersection point between the striking face and a straight line that passes through the head center of gravity and is perpendicular to the striking face, when the face portion is divided into an upper part and a lower part by a horizontal plane that passes through the sweet spot, the lower part includes a thick wall portion that has a wall thickness greater than a maximum wall thickness of the upper part, at least a part of the thick wall portion is a thickest wall portion that has a maximum wall thickness in the face portion, the golf club head further includes a sole connection portion formed between the thick wall portion and the sole portion, the sole connection portion has a wall thickness smaller than the maximum wall thickness of the upper part, when a width of 30% of an up-down directional width of the lower part at a position of the face center is referred to as an offset width, and, of the lower part, a region that has a width of the offset width and has a lower contour coinciding with a contour line of the striking face is defined as a lower peripheral region, then an entirety of the thick wall portion is disposed in the lower peripheral region, the thickest wall portion has a wall thickness of greater than or equal to 3.00 times a minimum wall thickness of the upper part and less than or equal to 6.00 times the minimum wall thickness of the upper part, and in a front elevation view of the golf club head, when a projected area of the thick wall portion is denoted by S1, and a projected area of the striking face is denoted by S2, then S1/S2 is greater than or equal to 5% and less than or equal to 45%.

13. The golf club head according to claim 12, wherein the entirety of the thick wall portion is disposed on a lower side with respect to the head center of gravity.

14. The golf club head according to claim 12, wherein the thick wall portion is divided and separately disposed in a toe-side part and a heel-side part of the face portion.

15. A golf club head comprising:

a face portion that includes a striking face;

a sole portion;

a crown portion;

a hosel portion; and a head center of gravity, wherein the striking face includes a face center and a sweet spot that is an intersection point between the striking face and a straight line that passes through the head center of gravity and is perpendicular to the striking face, when the face portion is divided into an upper part and a lower part by a horizontal plane that passes through the sweet spot, the lower part includes a thick wall portion that has a wall thickness greater than a maximum wall thickness of the upper part, at least a part of the thick wall portion is a thickest wall portion that has a maximum wall thickness in the face portion, when a width of 30% of an up-down directional width of the lower part at a position of the face center is referred to as an offset width, and, of the lower part, a region that has a width of the offset width and has a lower contour coinciding with a contour line of the striking face is defined as a lower peripheral region, then an entirety of the thick wall portion is disposed in the lower peripheral region, the thickest wall portion has a wall thickness of greater than or equal to 3.00 times a minimum wall thickness of the upper part and less than or equal to 6.00 times the minimum wall thickness of the upper part, and in a front elevation view of the golf club head, when a projected area of the thick wall portion is denoted by S1, and a projected area of the striking face is denoted by S2, then S1/S2 is greater than or equal to 5% and less than or equal to 45%, the thick wall portion is divided and separately disposed in a toe-side part and a heel-side part of the face portion, when the face portion is divided into a toe-side region that extends from a toe-most end of the face portion and has a toe-heel directional length of 30% of a face length, a heel-side region that extends from a heel-most end of the face portion and has a toe-heel directional length of 30% of the face length, and a central region that is located between the toe-side region and the heel-side region, then the thick wall portion is divided into a toe thick-wall part that is disposed in the toe-side region and a heel thick-wall part that is disposed in the heel-side region, and the thick wall portion is not present in the central region.

16. The golf club head according to claim 12, wherein when the face portion is divided into a toe-side region that extends from a toe-most end of the face portion and has a toe-heel directional length of 30% of a face length, a heel-side region that extends from a heel-most end of the face portion and has a toe-heel directional length of 30% of the face length, and a central region that is located between the toe-side region and the heel-side region, then the thick wall portion extends from the toe-side region through the central region to the heel-side region.

17. A golf club head being a driver head and comprising:

a face portion that includes a striking face;

a sole portion;

a crown portion;

a hosel portion; and a head center of gravity, wherein the striking face includes a face center and a sweet spot that is an intersection point between the striking face and a straight line that passes through the head center of gravity and is perpendicular to the striking face, when the face portion is divided into an upper part and a lower part by a horizontal plane that passes through the sweet spot, the lower part includes a thick wall portion that has a wall thickness greater than a maximum wall thickness of the upper part, at least a part of the thick wall portion is a thickest wall portion that has a maximum wall thickness in the face portion, the golf club head further includes a sole connection portion formed between the thick wall portion and the sole portion, the sole connection portion has a wall thickness smaller than the maximum wall thickness of the upper part, and when a width of 30% of an up-down directional width of the lower part at a position of the face center is referred to as an offset width, and, of the lower part, a region that has a width of the offset width and has a lower contour coinciding with a contour line of the striking face is defined as a lower peripheral region, then an entirety of the thick wall portion is disposed in the lower peripheral region.

18. The golf club head according to claim 17, wherein the entirety of the thick wall portion is disposed on a lower side with respect to the head center of gravity.

19. The golf club head according to claim 18, wherein the head center of gravity has a height of less than or equal to 33 mm.

20. The golf club head according to claim 17, wherein the head center of gravity has a depth of less than or equal to 22 mm.

* * * * *